United States Patent [19]

Fischer

[11] 4,121,374

[45] Oct. 24, 1978

[54] TOY ASSEMBLY KIT

[76] Inventor: Artur Fischer, Weinhalde 34, D-7244 Waldachtal 3, (Tumlingen), Fed. Rep. of Germany

[21] Appl. No.: 792,594

[22] Filed: May 2, 1977

[30] Foreign Application Priority Data

May 26, 1976 [DE] Fed. Rep. of Germany ..... 2623615

[51] Int. Cl.[2] ..... A63H 33/08

[52] U.S. Cl. ..... 46/24; 46/26

[58] Field of Search ..... 46/16, 23–26

[56] References Cited

U.S. PATENT DOCUMENTS

| | | | |
|---|---|---|---|
| 3,479,762 | 11/1969 | Fischer | 46/16 |
| 3,486,268 | 12/1969 | Fischer | 46/16 |
| 3,605,323 | 9/1971 | Fischer | 46/26 |

*Primary Examiner*—Louis G. Mancene
*Assistant Examiner*—Robert F. Cutting
*Attorney, Agent, or Firm*—Michael J. Striker

[57] ABSTRACT

A toy assembly kit includes a building block having an exposed surface, and an undercut male coupling element of one-piece with the block and projecting from the exposed surface. The male coupling element has a free end face and a predetermined length intermediate the latter and the exposed surface. A support plate is connectable with the block and has two substantially parallel major surfaces spaced apart at a distance which substantially corresponds to said predetermined length. The plate has wall portions bounding a slot which extends intermediate the major surfaces, and these wall portions include a pair of ridges at opposite sides of the slot. These ridges project into the slot at a location substantially midway between the major surfaces and bound a pair of undercut female coupling recesses in the slot. Each recess has a cross-sectional area dimensioned to receive the male coupling element and for thereby interconnecting the block and plate.

11 Claims, 2 Drawing Figures

TOY ASSEMBLY KIT

BACKGROUND OF THE INVENTION

The present invention generally relates to a toy assembly kit and, more particularly, to a multi-component toy construction kit having a plurality of structural components which are readily and releasably connectable to other structural components.

It has been proposed to form one structural component of a toy assembly kit as a building block, and another structural component as a support plate. A male coupling portion or stud extends outwardly from the block and is slidingly received in a female coupling portion or groove formed in the support plate. The kit may include a plurality of such blocks each having a plurality of studs, as well as a plurality of such plates each having a plurality of such grooves.

In order to mount building blocks on either side of a respective plate, the groove extends to both opposite major surfaces of the plate. The inner contour of the groove is dimensioned to receive two male studs simultaneously. That is, a male stud of one block is received in one section of the groove adjacent one major surface of the plate, and another male stud of another block is simultaneously received in another adjacent section of the groove adjacent the opposite major surface of the plate. The composite configuration of this groove is generally square-shaped.

If the stud is of undercut configuration, then each section of the groove must also be of compatible undercut configuration. In this case, the composite configuration of the groove can be characterized as generally hexagonally-shaped.

In either event, the support plate must have a thickness which corresponds to twice the predetermined length of a single stud in order to accommodate two studs at the same time. It is desirable to save as much material in the manufacture of this support plate as is possible without adversely affecting the characteristics and performance thereof. Furthermore, if less material is used, the support plate will be of lighter weight.

SUMMARY OF THE INVENTION

Accordingly, it is thus a general object of the present invention to overcome the disadvantages of the prior art.

A more specific object of the invention is to provide a support plate which is lighter in weight than similar structural elements known heretofore.

A further object of the invention is to provide a support plate which requires less material than structural elements of this type which are presently known.

Still another object of the invention is to provide such a toy building kit which is relatively simple and inexpensive to manufacture, and which will provide a child playing with the kit with maximum versatility and stimulation.

In keeping with these objects and others which will become apparent hereinafter, one feature of the invention resides, briefly stated, in a toy assembly kit which comprises a first structural component, e.g. a building block, having an exposed surface. A male coupling element projects from this exposed surface and has a free end face. The male coupling element has a predetermined length intermediate the free end face and the exposed surface. A second structural element, e.g. a support plate, is connectable with the first component and has two substantially parallel major surfaces spaced apart at a distance which substantially corresponds to the aforementioned predetermined length. The second component has wall portions bounding a slot or groove which extends intermediate the major surfaces. The wall portions include a pair of ridges at opposite sides of the slot. These ridges project into the slot at a location substantially midway between these major surfaces and bound a pair of female coupling recesses in the slot. Each recess has a cross-sectional area dimensioned to receive the male coupling element and for thereby interconnecting the components.

In accordance with the invention, the slot has two outwardly flaring recesses. This doubly-outwardly flaring slot has a total length which corresponds to the thickness of the plate, as well as substantially to the predetermined length of the male coupling element. A block can still be inserted either from above or below the plate. For manufacturing purposes, the plate has a much reduced thickness as compared with prior-art constructions. The invention thereby saves material and reduces the weight of the support plate.

In accordance with another feature of the invention, the slot is provided with an enlarged entrance cavity at a longitudinal edge of the plate. The enlarged cavity provides access for a male coupling element when one wishes to insert the building block from directly above or below the slot. This is especially desirable when two support plates are situated adjacent each other, and access to the open end of the slot at the respective longitudinal edge of one plate is obstructed by the other plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
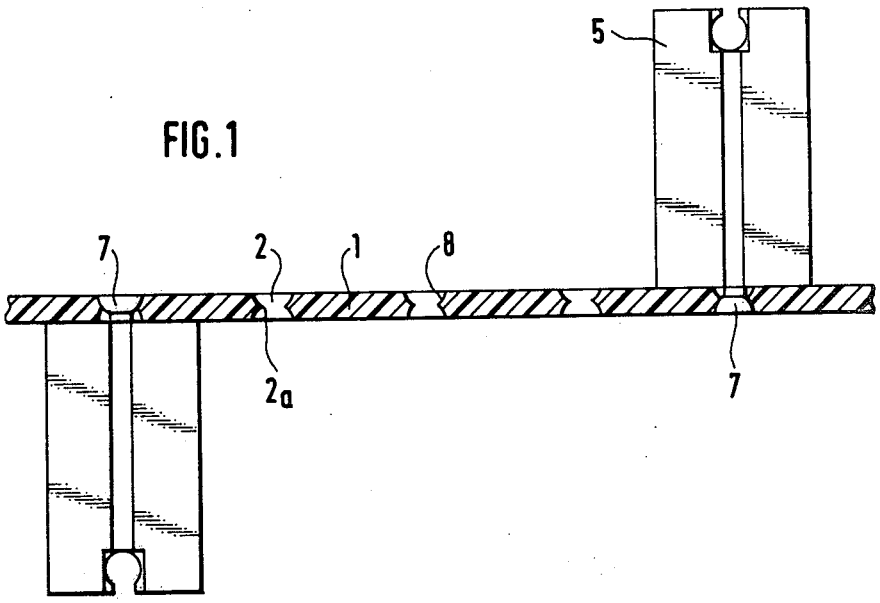
FIG. 1 is a broken-away sectional view of a support plate having two building blocks mounted thereon in accordance with the present invention.

FIG. 1 shows a partial sectional view of an elongated first structural component or support plate 1 constituted preferably of resilient synthetic plastic material. At least one (two are shown for illustration purposes) second structural component or parallelopiped building block 5, also preferably constituted by resilient synthetic plastic material, is detachably connected with the plate 1. This connection is obtained by inserting undercut male coupling elements into cooperating undercut female coupling elements or recesses of complementary contour.

Each block 5 has an exposed surface at its periphery. A male coupling element or undercut stud 7 projects from this exposed surface and terminates in a generally planar free end face. Stud 7 has a cylindrical neck portion which extends from the exposed surface, and a outwardly flaring head portion which extends from the neck portion to the free end face. The stud 7 has a predetermined length intermediate the free end face and the exposed surface.

The rectangular plate 1 is elongated in direction of longitudinal axis 4. Longitudinal edges 3 at the periphery of plate 1 extend lengthwise of axis 4. Plate 1 has two substantially parallel major surfaces which are spaced apart of each other at a distance which substantially corresponds to said predetermined length.

At least one, and preferably a plurality of elongated slots 2 extend transversely of axis 4 from a respective longitudinal edge 3 towards the middle of the plate 1. The slots 2 on opposite sides of the plate 1 terminate before reaching the central longitudinal axis 4 and thereby form a middle portion 6.

The plate 1 has arcuate wall portions bounding each slot 2. These arcuate wall portions include elongated edges or ridges **2*a* which extend lengthwise of the slot 2 over substantially the major portion thereof. Each ridge 2*a* is located at opposite sides of a respective slot 2 and projects into the slot at a location which is substantially midway between the major surfaces of the plate 1**.

Each slot 2 has a doubly outwardly flared configuration comprised of a pair of female coupling recesses 8. Each recess 8 has a generally semi-circular cross-section for receiving a respective outwardly flaring head portion of a stud 7. The semi-circular recesses 8 overlap each other and thereby form a hourglass-like contour for the slot 2.

In order to interconnect the various components, a stud 7 is positioned at the open end of a respective slot 2 at a respective longitudinal edge 3 so that the exposed surface of block 5 engages one of the major surfaces of the plate. Since the predetermined length of the stud 7 substantially corresponds to the thickness of the plate 1, the outwardly flaring head of stud 7 is located adjacent the recess 8 which is located further away from block 5, and the neck portion of stud 7 is located adjacent the recess which is located closer to block 5.

Thereupon, the block 5 is slid lengthwise of slot 2, and the stud is received in the more remote recess with snap-type action due to the resilient nature of the synthetic plastic material block 5 and plate 1. The free end face of the stud 7 is substantially flush with the other major surface of the plate 1 which lies furthest away from the block 5. The block 5 can be mounted either above or below plate 1. Moreover, the block 5 can be mounted in either direction substantially anywhere on either major surface of plate 1.

Figure 2:
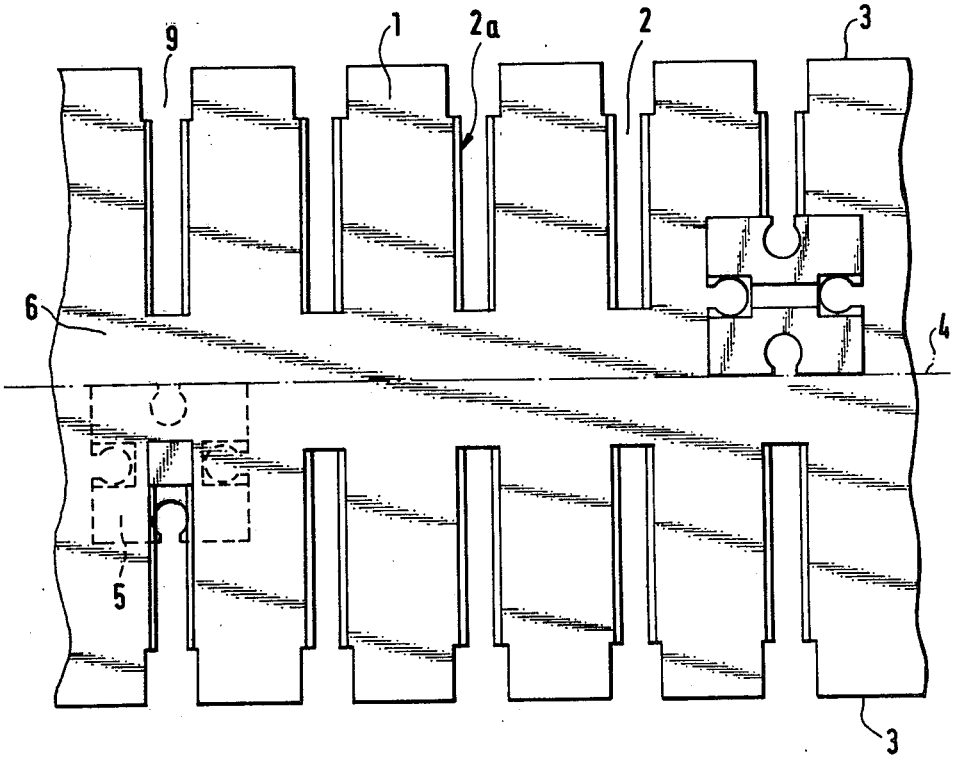
FIG. 2 is a top-plan view of FIG. 1.

An entrance cavity or groove 9 is provided for each slot 2 at a respective edge 3. Cavity 9 communicates with slot 2 and extends across the entire thickness of plate 1. As shown in FIG. 2, cavity 9 is enlarged relative to slot 2 and facilitates entrance of a male stud 7 into the slot 2. In the event that two plates are located adjacent each other so that their respective longitudinal edges are in physical contact with one another, then cavity 9 provides the only access into a respective slot 2.

The toy assembly kit includes a plurality of building blocks and support plates. Many interconnections are possible between these structural components, for example a plurality of blocks 5 can be mounted on a single plate 1 and vice versa. The male coupling element need not be of one-piece with the block 5, but may constitute a separate discrete element which is mountable on a block 5.

It will be understood that each of the elements described above, or two or more together, may also find a useful application in other types of constructions differing from the types described above.

While the invention has been illustrated and described as embodied in a toy assembly kit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy assembly kit, comprising a first structural component having an exposed surface and a male coupling element projecting from said exposed surface by a predetermined length and having an undercut portion; and a second structural component connectable with said first structural component and having two substantially parallel major surfaces spaced from one another and an elongated slot extending from one to the other of said major surfaces, said major surfaces of said second structural component being spaced from one another by a distance corresponding to said predetermined length of said male coupling element of said first structural component, and said slot having two portions which diverge from one another in direction towards the respective major surfaces from a location midway between said major surfaces so that said portions of said slot are mirror-symmetrical with reference to one another, each of said portions having a cross-sectional matching the cross-section of said undercut portion of said male coupling element of said first structural component so that said male coupling element can be received into said slot when said first structural component is located at either of said major surfaces of said second structural component without the thickness of the latter exceeding said predetermined length of said male coupling element.

2. A kit as defined in claim 1, wherein said second structural component has wall portions including a pair of ridges which are located at opposite sides of said slot and midway between said major surfaces so as to bound said portions of said slot.

3. A kit as defined in claim 1, wherein said male coupling element is of one-piece with said first structural component.

4. A kit as defined in claim 1, wherein said male coupling element has a cylindrical neck portion which projects from said exposed surface, and an enlarged head portion which increases in cross-section in direction away from said neck portion and forms said undercut portion.

5. A kit as defined in claim 1, wherein said first structural component is a building block of resilient synthetic plastic material.

6. A kit as defined in claim 2, wherein each portion of said slot decreases in cross-sectional area from a respective major surface towards said ridges.

7. A kit as defined in claim 1, wherein said second structural component has wall portions bounding said slot, said wall portions are arcuate.

8. A kit as defined in claim 1, wherein said second structural component is a generally rectangular plate of resilient synthetic plastic material.

9. A kit as defined in claim 1, wherein said second structural component is elongated and has longitudinal edges, and wherein said slot extends inwardly from one of said edges in direction transversely of said second component.

10. A kit as defined in claim 9; and further comprising a plurality of additional elongated slots, each of said slots extending from a respective longitudinal edge in direction transversely of said second component, all of said slots extending substantially parallel relative to each other.

11. A kit as defined in claim 9, wherein said second structural component has wall portions which bound said slot and further bound an entrance cavity at one of said edges and communicating with said slot, said cavity being enlarged relative to said slot for facilitating entrance of said male coupling element into said slot.

* * * * *